US005564301A

United States Patent [19]

Rönnmark

[11] Patent Number: 5,564,301

[45] Date of Patent: Oct. 15, 1996

[54] ADJUSTABLE DIE ASSEMBLY

[75] Inventor: Ulf Rönnmark, Skelleftea, Sweden

[73] Assignee: NYA Ursvikens Mekaniska Verkstads AB, Sweden

[21] Appl. No.: 428,127

[22] Filed: Jun. 23, 1995

[30] Foreign Application Priority Data

Oct. 26, 1992 [SE] Sweden ..... 9203125

[51] Int. Cl.[6] ..... B21D 37/04

[52] U.S. Cl. ..... 72/389.4; 72/446; 72/482.1

[58] Field of Search ..... 72/389.4, 389.5, 72/446, 482

[56] References Cited

U.S. PATENT DOCUMENTS

| | | | |
|---|---|---|---|
| 784,725 | 3/1905 | Yates | 72/389.4 |
| 4,106,323 | 8/1978 | Haenni et al. | 72/448 |
| 4,366,698 | 1/1983 | Gill | 72/389.4 |
| 5,249,452 | 10/1993 | Baldwin et al. | 72/389.4 |
| 5,305,659 | 4/1994 | Dieperink et al. | 72/389.4 |

FOREIGN PATENT DOCUMENTS

| | | |
|---|---|---|
| 0140394 | 5/1985 | European Pat. Off. . |
| 3235775 | 3/1984 | Germany . |
| WO9103332 | 3/1991 | WIPO . |

*Primary Examiner*—David Jones

*Attorney, Agent, or Firm*—Ware, Fressola, Van Der Sluys & Adolphson

[57] ABSTRACT

This invention relates to an arrangement at lower tools for edging presses and the like where a pair of jaws or pads are displaceable in at least the one direction by means of a system including obliquely arranged surfaces. The novelty lies in that there are arranged at a first sliding face of a sliding plate, a number of slots or recess (3) in pairs and positioned in opposing directions on each side of a central plane of the tool and at second inverted sliding faces each connected to a jaw or pad means (12) mirror inverted slots (8) having greater length than the former slots and in that in the shorter slots there are arranged keys having a depth adapted to the slots so that a protruding portion of each key projects into each of the elongated slots.

3 Claims, 4 Drawing Sheets

2
2
12
7
24
23
25
21
22
15
1
21
11
10
9

7
12
15
30
28
13
12
14
7
8
1

ADJUSTABLE DIE ASSEMBLY

BACKGROUND OF THE INVENTION

1. Technical Field of the Invention

This invention relates to lower tools for edging or folding presses and other sheet metal forming machines and more in detail to lower tools having laterally adjustable pads or abutments.

2. Description of the Prior Art

WO 91/03332 discloses an arrangement having two pad halves laterally displaceable on a support portion of the lower tool on each sides of the central plane of the tool. Lateral movement in the closing direction is achieved by intermediary bodies having obliquely arranged surfaces engaging a straight abutment rod and also engaging complementary obliquely arranged surfaces at the two pad halves in order to allow those to approach each other. A relative displacement in separating direction is achieved by blade spring means mounted between the pad halves and biassed in such a way that they urge to separate those.

The locking in the positions reached is achieved by the engagement between the obliquely arranged surfaces and consequently the pulling device has to be extremely precise in its movements in order to avoid play. Further, there is a demand for the pad halves to be equipped with a foot portion having a width large enough to maintain the lateral stability as required.

SUMMARY OF THE INVENTION

One object of the invention is to provide an arrangement where the pad halves with jaws thereon can be precisely displaced relatively to each other and also can be rigidly locked in each position reached. In addition, the jaws are supported in such a way that the risk of turning over or tilting of the jaws is eliminated.

This invention is based on the idea that displacement in the longitudinal direction of the lower tool of the two pad halves causes the obliquely arranged surfaces thereof, by means of an intermediary connecting or guiding body, to cooperate with obliquely arranged surfaces on the lower tool thereby achieving lateral displacement of the pad halves from and toward each other. Locking bosses are displaceable in the length direction of the lower tool and engage obliquely and sloping surfaces at the pad halves to cause a locking of the pad halves relative to the stationary part of the lower tool.

Furthermore, the driving for the displaceable locking means is arranged in such a way that the necessary displacement of the locking means is at a minimum and consequently quick.

DESCRIPTION OF THE DRAWINGS

A preferred embodiment of the invention will be described more in detail in the following with references to the attached drawings, in which.

DETAILED DESCRIPTION OF INVENTION

Figure 1:
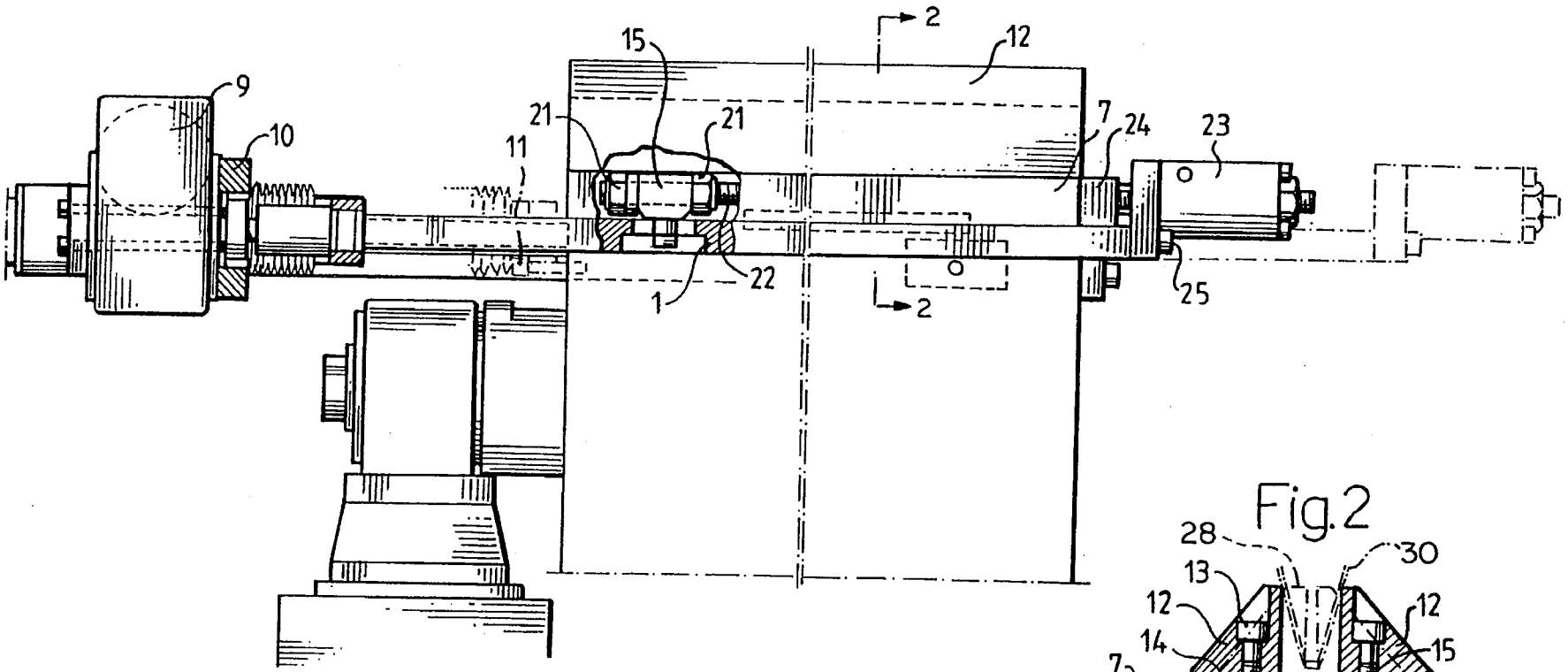
FIG. 1 is a fragmentary side elevational view of a lower tool arranged according to the invention.

In the drawings only details necessary for the understanding of the invention have been included and other details for the sake of clarity are only indicated by dotted or phantom lines.

Figure 3:
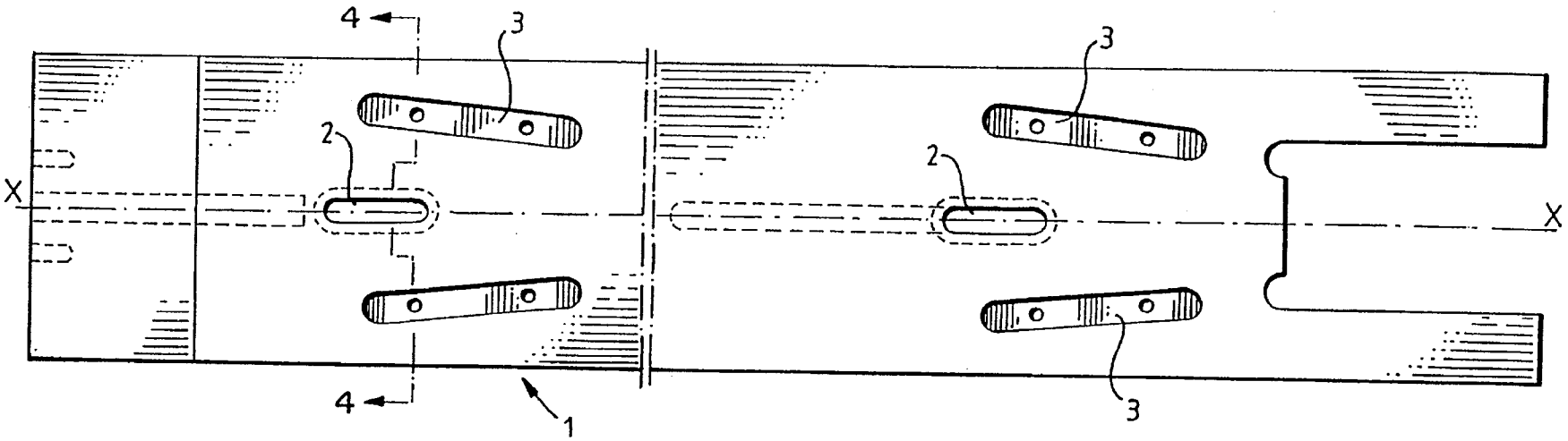
FIG. 3 is a top view of the essentially stationary base plate of the lower tool.
Figure 4:
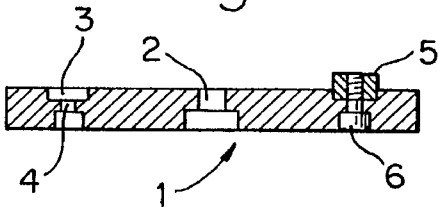
FIG. 4 is a sectional view along the line 4—4 of FIG. and showing one of the keys in place.

On a bottom frame (not shown in detail), there is arranged a base or slide plate 1 and this one which is illustrated in FIG. 3 and 4 has a number of stepped undercut elongated through apertures 2 arranged one after the other along the longitudinal centerline X and obliquely arranged bottom slot-like recesses 3 arranged in pairs on each side of the longitudinal centerline X. It is to be noted that, on the drawing only two groups of recesses 3 are shown, whereas, in reality, the number is greater. The bottom recesses 3 arranged in pairs have bores 4 (FIG. 4) for screws 6 (one shown in FIG. 4). The bores 4 are countersunk on the lower side of the slide plate 1 to accommodate the heads of the screws 6. The recesses 3 are dimensionally sized to act as seats to receive standard keys 5, which completely fill each such recess 3 and are secured therein by means of the screws 6. The depth of the recesses 3 is so related to the thickness of the keys 5 that a portion of each key 5 projects above the surface of the slide plate 1.

Figure 2:
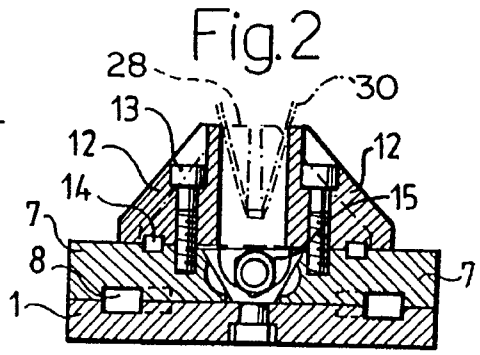
FIG. 2 is a sectional view along the line 2—2 of FIG. 1 and showing the upper tool and workpiece in phantom line.

Turning to FIG. 2, two holder rods 7 are arranged to be supported by the slide plate 1 and the holder rods 7 have on their lower side obliquely arranged elongated slots 8 arranged in pairs with the same pitch as the bottom recesses 3 of the slide plate 1. The depth of the slots 8 is essentially equal with the depth of the recesses 3. It is essential that the depth of the slots 8 is sufficiently large so that the upper faces of the keys 5 projecting into the holder rod slots 8 from below and secured inside the bottom recesses 3 of the slide plate 1 are spaced from the inner or upper bottom surface of the holder rod slots 8. By this arrangement, the holder rods 7 will be supported by the upwardly facing surface of the slide plate 1 instead of by the keys 5.

The length of the bottomslots 8 of the holder rods 7 is much greater than the length of the recesses 3 of the slide plate 1. The bottom slots 8 arranged at the lower side of each holder rod 7 are, like the bottom recesses 3 of the slide plate 1, mutually in parallel and are at the same angle relatively to the longitudinally centerline X. The angles of the bottom slots 8 are the same value on both sides of the centerline X but are mirror images of each other. The considerably greater length of the slots 8 arranged in the holder rods 7 than that of the recesses 3 of the slide plate 1 permits the holder rods 7 to be displaced relative to the slide plate 1. Upon such displacement, the holder rods 7 can move in the longitudinal direction of the slide plate 1 and also laterally thereof. The holder rods 7 are connected to a common ram device 9 mounted on a bracket 10 by means of screws 11 secured to the end of the slide plate 1. By means of this ram device 9, the holder rods 7 may be displaced in the one or the other longitudinal direction whereby they also will move towards and away from each other depending upon the direction of their longitudinal displacement.

The holder rods 7 are guided by means of the engagement of the keys 5 in the slots 8. The guiding takes place in an exact and uniform way along the whole length of the tool.

As best seen in FIG. 2, at each holder rod 7 there is a pad part or jaw 12 secured by means of screws 13. Each jaw 12 is laterally positioned by means of flat keys 14 whereby each holder rod 7 and its associated one jaw 12 form a unit.

Figure 8:
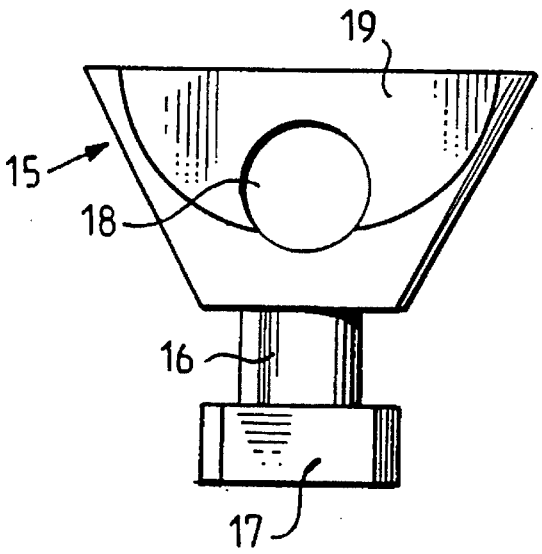
FIG. 8 is an end elevational view in enlarged scale of one of the locking means.
Figure 9:
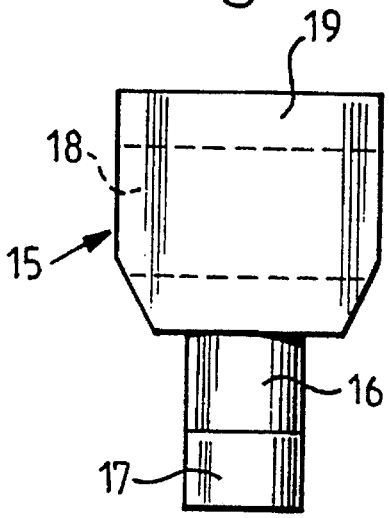
FIG. 9 is a side elevational view of the same locking means.
Figure 10:
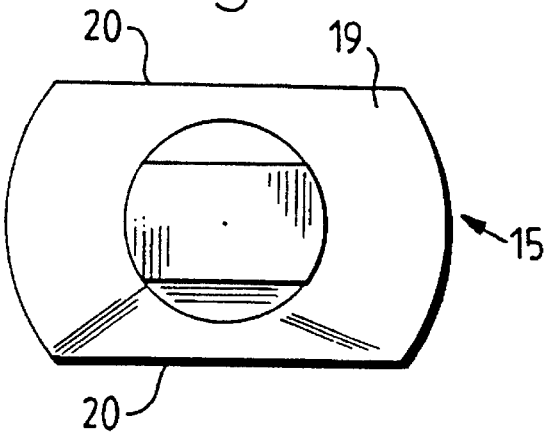
FIG. 10 is a top plan view of the locking means.

In order to establish a stable and nonyielding locking and anchoring of the holder rods 7 with the jaws 12 in their desired positions of displacement, there is a system of locking bosses 15 (FIG. 2 ). Each locking boss 15 includes, as can be seen from FIG. 8–10, a shaft portion 16 at its lower end equipped with a cross piece 17 and at its upper end with frusto-conical head 19 having a radial bore 18 and being axially cut to form two parallel end faces 20.

As also appears from FIGS. 1 and 2, there are a number of locking bosses 15 threaded onto a threaded rod 22 and by means of nuts 21 stably anchored thereto. At one end of the rod, there is power driven handling means 23 such as a piston and cylinder arrangement. The handling means 23 is by means of an intermediary piece 24 secured to the slide plate 1 by means of bolts 25, which means that the position relatively thereto is constant.

Figure 5:
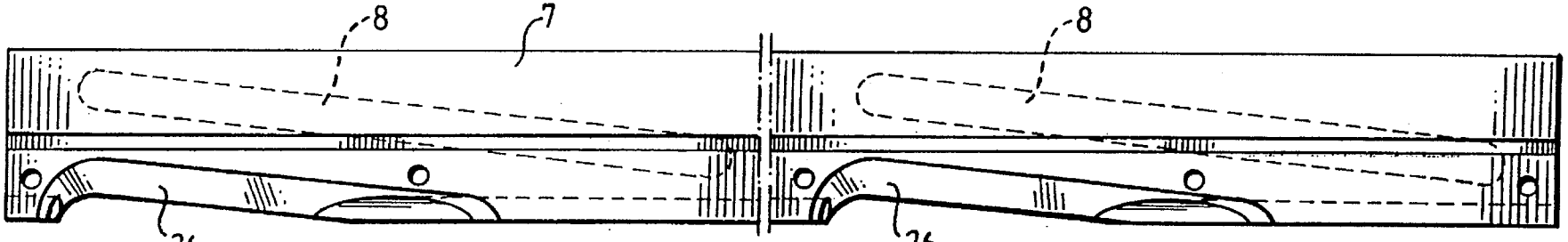
FIG. 5 and 6 are top plan views of the two pad parts.
Figure 6:
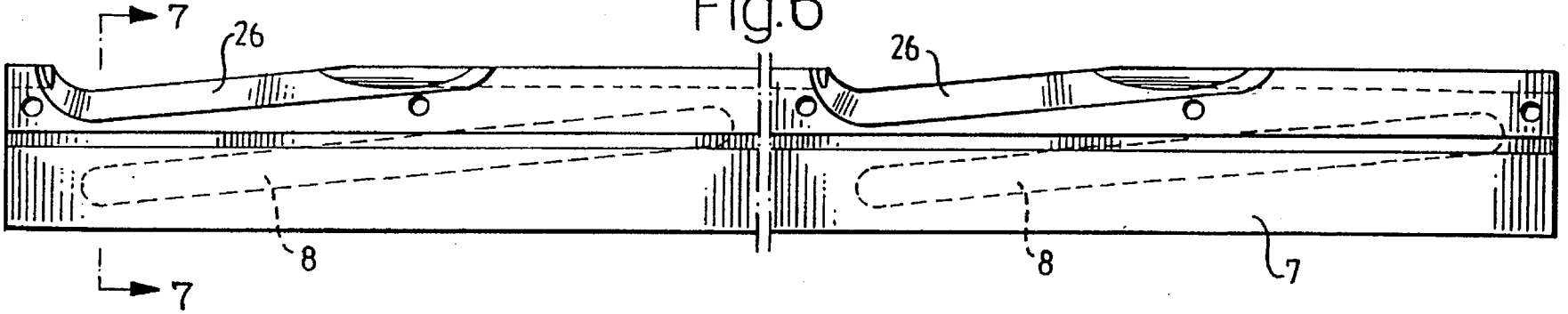
Figure 7:
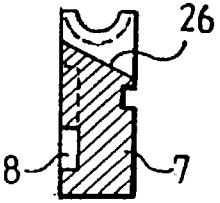
FIG. 7 is a sectional view along the line 7—7 of FIG. 6.

As seen in FIGS. 5, 6 and 7, the edges of the holder rods 7 facing each other have partly curved obliquely arranged abutment surfaces 26, which are inclined in an angle to the plane of the slide plate 1 corresponding to the tapering of the head 19 of the locking bosses 15. Additionally, the abutment surfaces 26 are inclined relatively to the longitudinal centerline X at angles corresponding to the angles in which the recesses 3 and slots 8 are oriented. The abutment surfaces 26 extend along the same distance as the keys 5 in the recesses 3. The movement of the locking bosses 15 in its axial direction is limited by means of the cross piece 17 at the lower part thereof projecting down through the longitudinally through apertures 2 where the cross piece 17 runs in the widened lower portion and thereby prevents the movement of the locking bosses 15 upwardly.

To change the set position for the jaws 12, the handling means 23 for the rod 22 carrying the locking bosses 15 is biassed so that each locking boss 15 is displaced to the area between the abutment surfaces 26 where the distance between those is the largest as shown in full line in FIG. 1. The locking bosses 15 do not form an obstacle to the continued setting operation. The Saws 12 are positioned as mentioned before by activating the driving means 9 which pulls or pushes the holder rods 7 in one or the other direction which results in an approaching or a separation of the jaws 12. On reaching intended position of the jaws 12, the handling means 23 for the rod 22 carrying locking bosses 15 is activated and displaces the locking bosses 15 towards the narrower end of the areas laterally defined by the abutment surfaces 26, i.e., towards the right as shown in dotted line in FIG. 1.

The locking bosses 15 also function to establish a locking action through the relative shapes of the holder rods 7 and the slide plate 1. The locking bosses 15, with their frusto-conical heads 19 engaging the abutment surfaces 26 of engagement of the holder rods 7, will be stably locked in intended positions and then the holder rod 7 carrying the jaws 12 will not be movable. The locking bosses 15 with their frusto-conical heads 19 cooperating with the abutment surfaces 26 of the holder rods 7 and the keys 5 preventing mutual displacement between the holder rods 7 and the slide plate 1 form a very secure locking against overturning or tipping of the jaws 12 in an outward direction during operation of the upper tool 28 in forming the workpiece 30 as shown in FIG. 2.

The invention is not limited to the embodiment described above but can be varied within the framework of the following patent claims.

I claim:

1. A lower tool assembly for a sheet metal forming machine having a machine frame, the lower tool assembly comprising:

(a) an upwardly facing sliding surface connected to the machine frame, the upwardly facing sliding surface having a centerline and at least two slot-like seats defined therein, each slot-like seat angled relative to the centerline;

(b) at least one essentially non-displaceably anchored guide body mounted in each slot-like seat, each guiding body having a length and a width dimensionally sized to fit in its associated seat and a height that exceeds the depth of the seat so that the guiding body projects out of the seat above the upwardly facing sliding surface;

(c) at least one downwardly facing sliding surface slidingly received on the upwardly facing sliding surface, each downwardly facing sliding surface having at least two elongated recesses angled relative to the centerline of the upwardly facing sliding surface, each elongated recess is positioned opposite one of the slot-like seats and has the at least one guide body from its associated slot-like seat extending thereinto, each elongated recess is longer than its associate slot-like seat; and (d) a jaw mounted on each downwardly facing sliding surface for movement therewith, whereby cooperation of the guiding bodies and their associated elongated recesses produces a lateral displacement of the at least one downwardly facing sliding surface and its associated jaw mounted thereon upon application of a force on the at least one downwardly facing sliding surface and the jaw mounted thereon in a direction parallel to the centerline.

2. A lower tool assembly according to claim 1, wherein the upwardly facing sliding surface is an upper surface of a slide plate displaceably arranged relatively to the machine frame, the slot-like seats being defined in said upper surface; the at least one downwardly facing sliding surface is two downwardly facing sliding surfaces provided by two holder rods positioned on opposite sides of the centerline, the elongated recesses are arranged in the two holder rods as mirror images on opposite sides of the centerline; and the guiding bodies are shaped as keys.

3. A lower tool assembly according to claim 2, wherein the slide plate has elongated through apertures therein; the holder rods are displaceable along the slide plate and have edges facing towards each other with obliquely cut surfaces essentially in parallel with the elongated recesses arranged in each holder rod; and further comprising locking bosses received within the elongated through apertures and limitedly displaceable therein, said locking bosses having lateral surface portions arranged obliquely corresponding to the obliquely cut surfaces of the holder rods, the locking bosses are displaceable by rigid driving means connecting the locking bosses and movable along the direction of the centerline in order to, on reaching engagement with the obliquely cut surfaces of the holder rods in cooperation with the guiding bodies and the elongated recesses, bring about a rigid positioning of the holder rods.

* * * * *

UNITED STATES PATENT AND TRADEMARK OFFICE

CERTIFICATE OF CORRECTION

PATENT NO. : 5,564,301

DATED : October 15, 1996

INVENTOR(S) : Ulf Rönnmark

It is certified that error appears in the above-indentified patent and that said Letters Patent is hereby corrected as shown below:

On the Title page, "[22] Filed: Jun. 23, 1995" should be:

--[22] PCT Filed: October 26, 1993

[86] PCT No.: PCT/SE93/00880
§ 371 Date: June 23, 1995
§ 102(e) Date: June 23, 1995

[87] PCT Pub. No.: WO 94/09924
PCT Pub. Date: May 11, 1994--.

In Col. 3, line 48, "Saws" should be --jaws--.

Signed and Sealed this

Eighteenth Day of February, 1997

*Attest:*

BRUCE LEHMAN

*Attesting Officer*

*Commissioner of Patents and Trademarks*